US010082003B2

(12) United States Patent
Sheehan et al.

(10) Patent No.: US 10,082,003 B2
(45) Date of Patent: Sep. 25, 2018

(54) THROUGH TUBING DIVERTER FOR MULTI-LATERAL TREATMENT WITHOUT TOP STRING REMOVAL

(71) Applicant: BAKER HUGHES INCORPORATED, Houston, TX (US)

(72) Inventors: Joseph Sheehan, Cypress, TX (US); Mihai Marcu, Spring, TX (US); Dennis M. Collins, Jr., Spring, TX (US); Scott F. Donald, Spring, TX (US); Richard R. Lafitte, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 219 days.

(21) Appl. No.: 15/155,966

(22) Filed: May 16, 2016

(65) Prior Publication Data

US 2017/0328177 A1 Nov. 16, 2017

(51) Int. Cl.

| | |
|---|---|
| ***E21B 41/00*** | (2006.01) |
| ***E21B 7/06*** | (2006.01) |
| ***E21B 29/06*** | (2006.01) |
| ***E21B 33/12*** | (2006.01) |
| ***E21B 34/10*** | (2006.01) |
| *E21B 34/00* | (2006.01) |

(52) U.S. Cl.

CPC ..... *E21B 41/0035* (2013.01); *E21B 7/061* (2013.01); *E21B 29/06* (2013.01); *E21B 33/12* (2013.01); *E21B 34/10* (2013.01); *E21B 2034/007* (2013.01)

(58) Field of Classification Search

CPC ..... E21B 41/0036; E21B 7/061; E21B 33/12; E21B 29/06; E21B 34/10; E21B 2034/007; E21B 10/64; E21B 10/66

See application file for complete search history.

(56) References Cited

U.S. PATENT DOCUMENTS

| | | | | |
|---|---|---|---|---|
| 6,053,254 | A * | 4/2000 | Gano | E21B 41/0035 166/117.6 |
| 8,590,608 | B2 | 11/2013 | Linn et al. | |
| 2013/0032355 | A1 | 2/2013 | Scott et al. | |
| 2013/0043043 | A1 | 2/2013 | Flores et al. | |
| 2018/0045021 | A1 | 2/2018 | Vu et al. | |

* cited by examiner

*Primary Examiner* — Brad Harcourt

(74) *Attorney, Agent, or Firm* — Steve Rosenblatt

(57) ABSTRACT

A main bore is drilled and a treatment assembly is located. A packer is located to support a whipstock for drilling the lateral. This packer serves as a lower seal on a main bore diverter. The whipstock is installed on the packer and a mill drills a window and the lateral. The mill is pulled and the whipstock removed with a fixed lug tool. A bottom hole assembly is run into the lateral which includes a diverter that is landed by the window. If cementing is called for it is done at this time. A top string is installed that isolates the upper casing. The lateral is treated with the main bore isolated. The diverter is retrieved through the top string. The main bore diverter is run in through top string and landed in the junction with the window and lateral isolated. The main bore diverter is removed through the top string. The treatment bottom hole assembly has a series of sliding sleeves operated by a single size ball.

12 Claims, 13 Drawing Sheets

THROUGH TUBING DIVERTER FOR MULTI-LATERAL TREATMENT WITHOUT TOP STRING REMOVAL

FIELD OF THE INVENTION

The field of the invention is treatment of at least one formation in a multilateral borehole and more specifically where the diverter can be removed through the top string and the treatment bottom hole assembly uses a sleeve array movable by a single ball size.

BACKGROUND OF THE INVENTION

In existing multilateral completions where a junction is located to provide access to a lateral and the main bore and a diverter is used to control the access. Typically an initial diverter is run into the junction to provide access to the main or lateral bore. The diverter in effect isolates the other of the bores so that the bore oriented for flow through the diverter is treated first. The top string is installed to isolate the casing above the junction. The top string must be removed to pull the first diverter and a second diverter with an orientation for the bore that has yet to be treated is run in. The top string is then reinstalled. At that point the other bore is treated.

The disadvantage of this system is the multiple trips with the top string to switch diverters. The present invention addresses the extra trip issue with a diverter that is small enough to come through the top string without having to remove the top string. Of course, moving the diverter through the top string puts a size limit on a diverter which also limits the drift dimension through the diverter. This can have an adverse effect on the number of fracturing stages that can be pumped during the treatment. To offset this effect the treatment bottom hole assembly that typically has multiple valves that have different size ball seats that increase in size as the treatment moves uphole is instead configured with a system where the ball seats on a collection of sleeves operate on a single ball size. This alleviates the negative affect of limiting the number of fracturing stages. While fracturing sleeve arrangements that operate with a single ball size are known in single boreholes with no laterals as shown in US 2013/0043043, such systems have never been used in multilateral applications and not in applications where the isolation of pressures across the junction is completed. These and other aspects of the present invention will be more readily apparent to those skilled in the art from a review of the detailed description of the preferred embodiment and the associated drawings while recognizing that the full scope of the invention is to be determined by the appended claims.

SUMMARY OF THE INVENTION

A main bore is drilled and a treatment assembly is located. A packer is located to support a whipstock for drilling the lateral. This packer serves as a lower seal on a main bore diverter. The whipstock is installed on the packer and a mill drills a window and the lateral. The mill is pulled and the whipstock removed with a fixed lug tool. A bottom hole assembly is run into the lateral which includes a diverter that is landed by the window. If cementing is called for it is done at this time. A top string is installed that isolates the upper casing. The lateral is treated with the main bore isolated. The diverter is retrieved through the top string. The main bore diverter is run in through top string and landed in the junction with the window and lateral isolated. The main bore diverter is removed through the top string. The treatment bottom hole assembly has a series of sliding sleeves operated by a single size ball.

DETAILED DESCRIPTION OF THE PREFERRED EMBODIMENT

Figure 1:
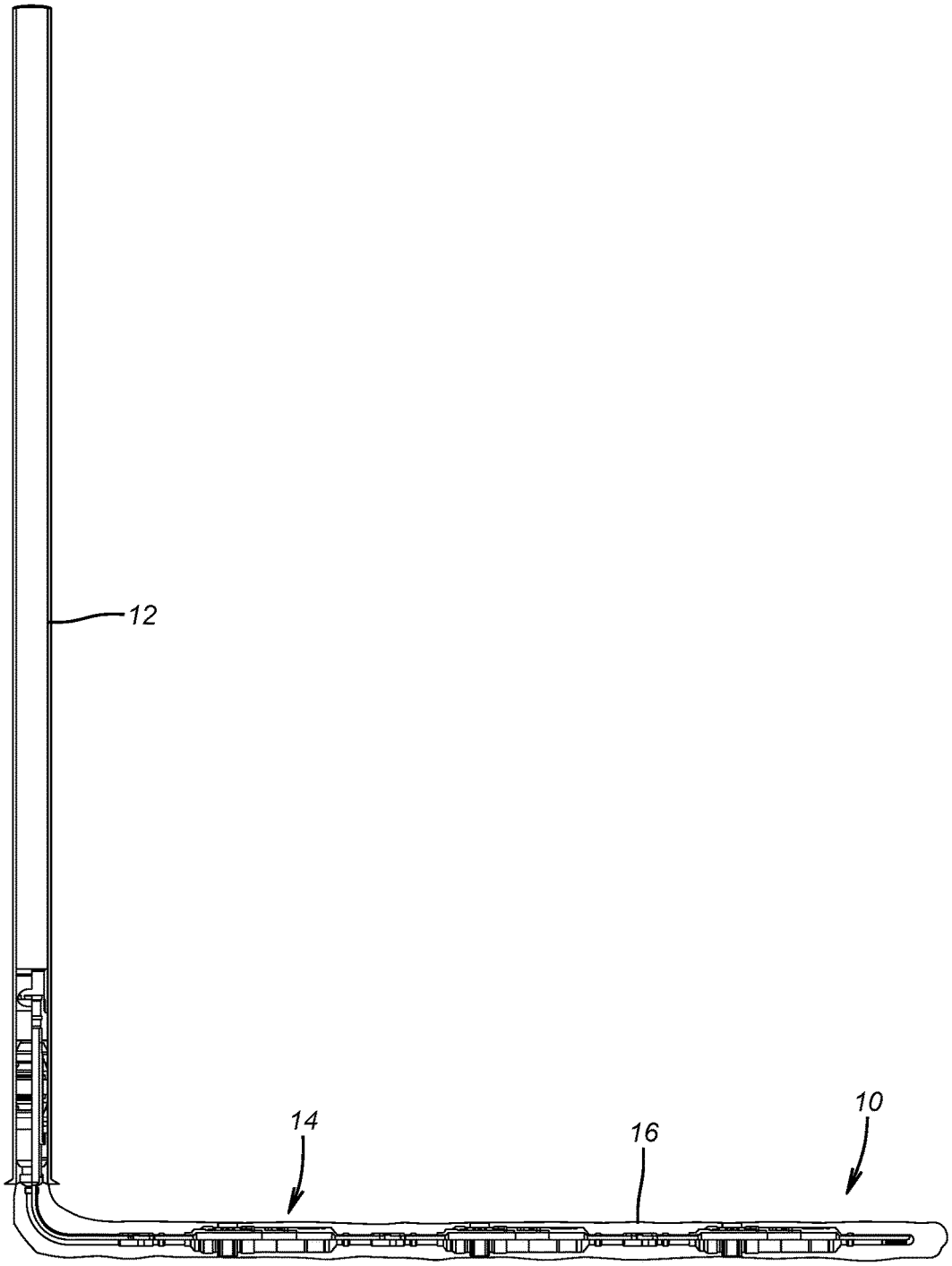
FIG. 1 shows a lower single ball treatment assembly being installed.
Figure 2:
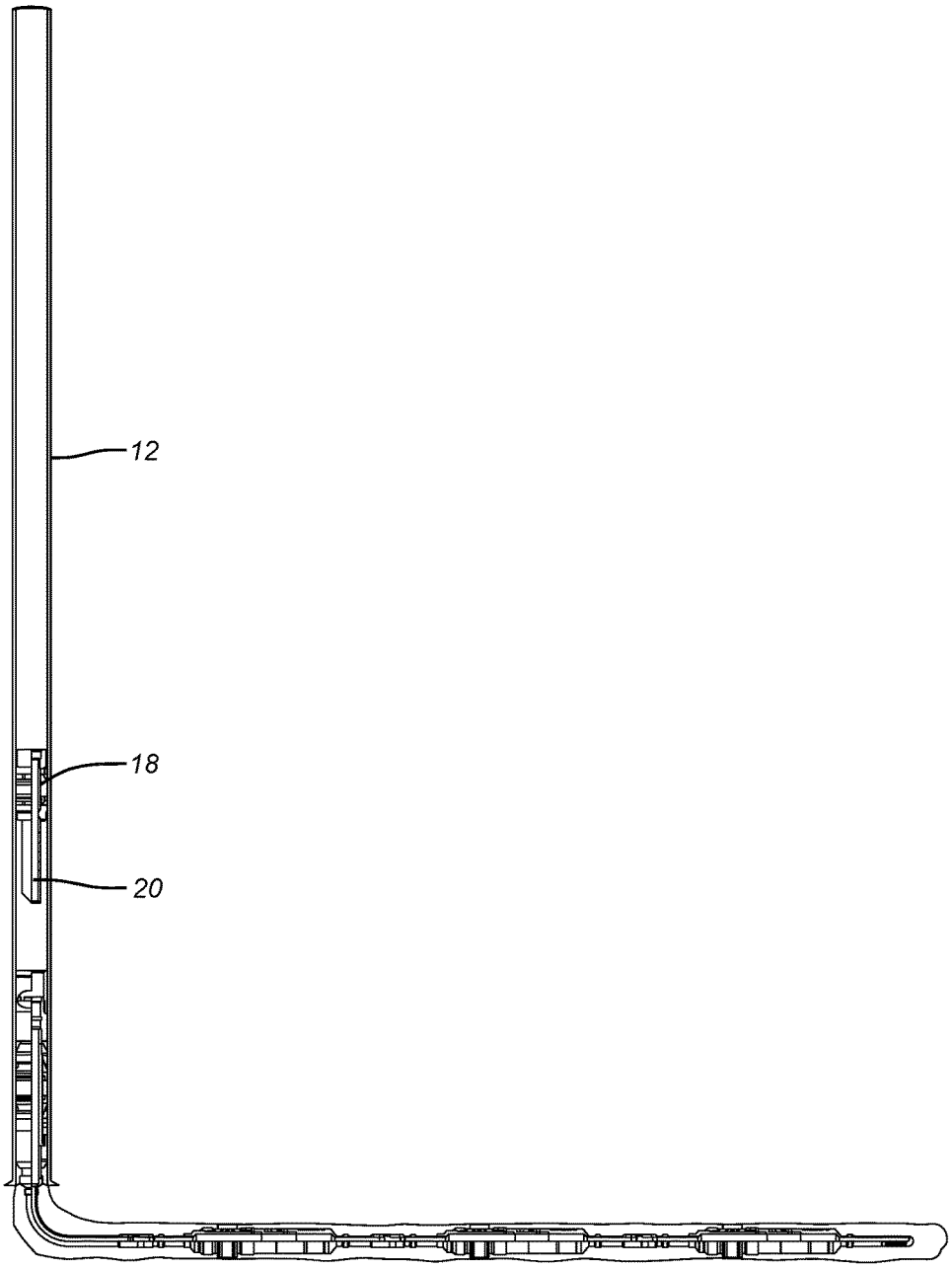
FIG. 2 shows the addition of a seal bore packer to the view of FIG. 1.
Figure 3:
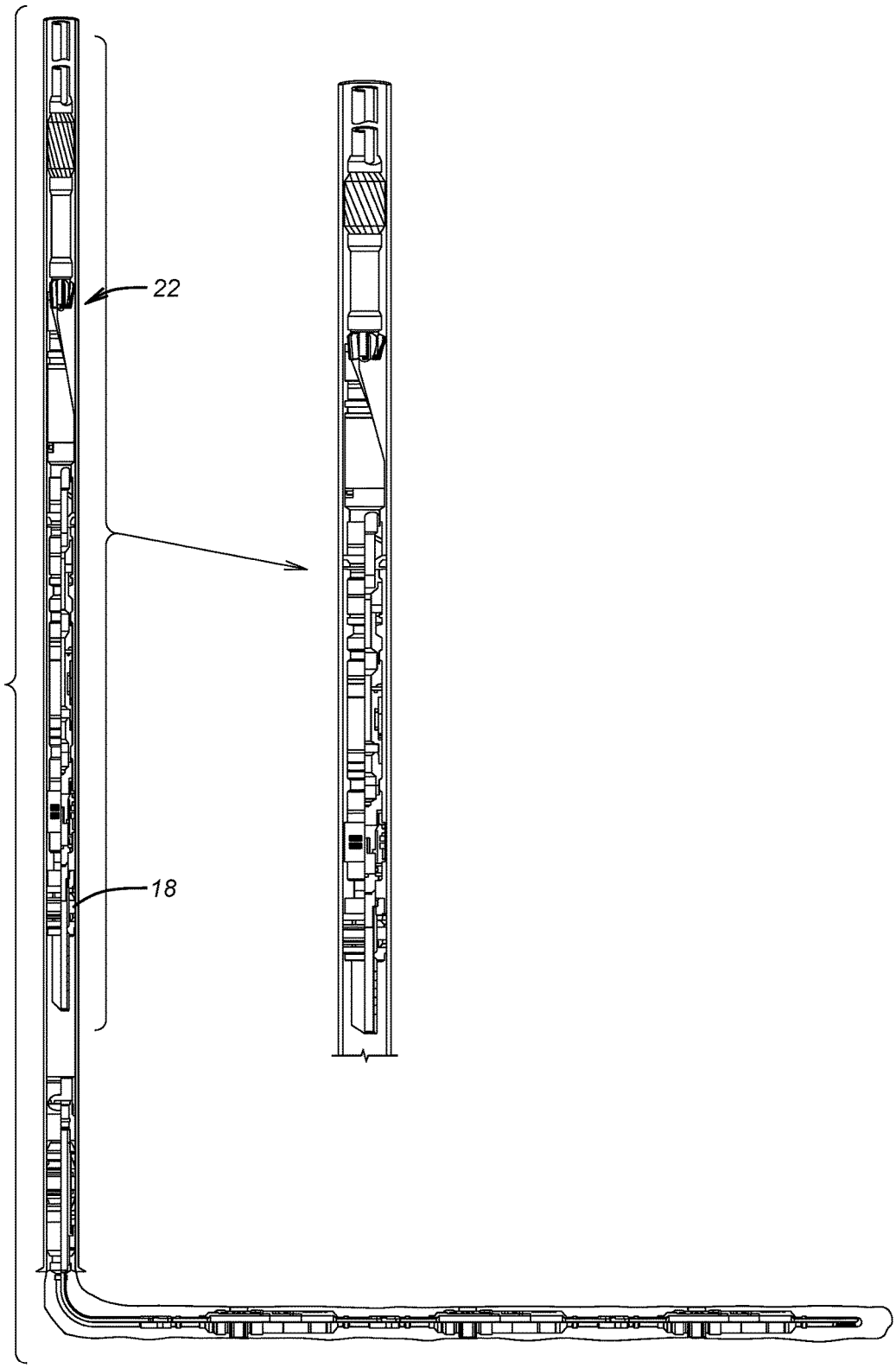
FIG. 3 shows tagging the milling assembly and whipstock into the seal bore packer of FIG. 2.
Figure 4:
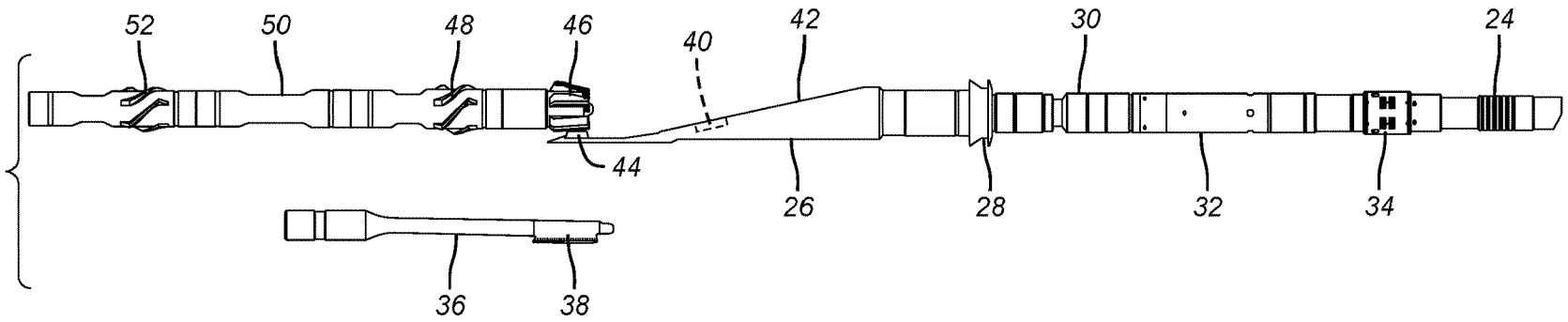
FIG. 4 is a detailed view of the milling assembly and the recovery tool that engages the whipstock for removal of the milling assembly.

FIG. 1 shows a horizontal bore 10 which is an open hole 16 with a treating assembly 14 which is adapted to sequentially open treating ports with a ball, balls or other objects that are the same size as will be described below. The upper part of the borehole 10 has casing 12. In FIG. 2 a seal bore packer 18 has a seal bore 20 is added in casing 12. In FIG. 3 a milling assembly 22 is tagged into packer 18. More specifically, as shown in FIG. 4 the seals 24 go into seal bore 20. The milling assembly 22 has a whipstock 26 with a ramp 42 followed by a debris excluder 28, a shear disconnect 30, an unloader valve 32 and an anchor 34 just above seals 24. A lug 44 supports a window mill 46 above which are a lower watermelon mill 48, a flex joint 50 and an upper watermelon mill 52. A removal tool 36 has a lug 38 to engage a recess or ramp opening 40 for retrieval of the assembly 22 down to seals 24. Assembly 22 shown in FIG. 4 is known in the art as Window Master® offered by Baker Hughes Incorporated of Houston Tex.

Figure 5:
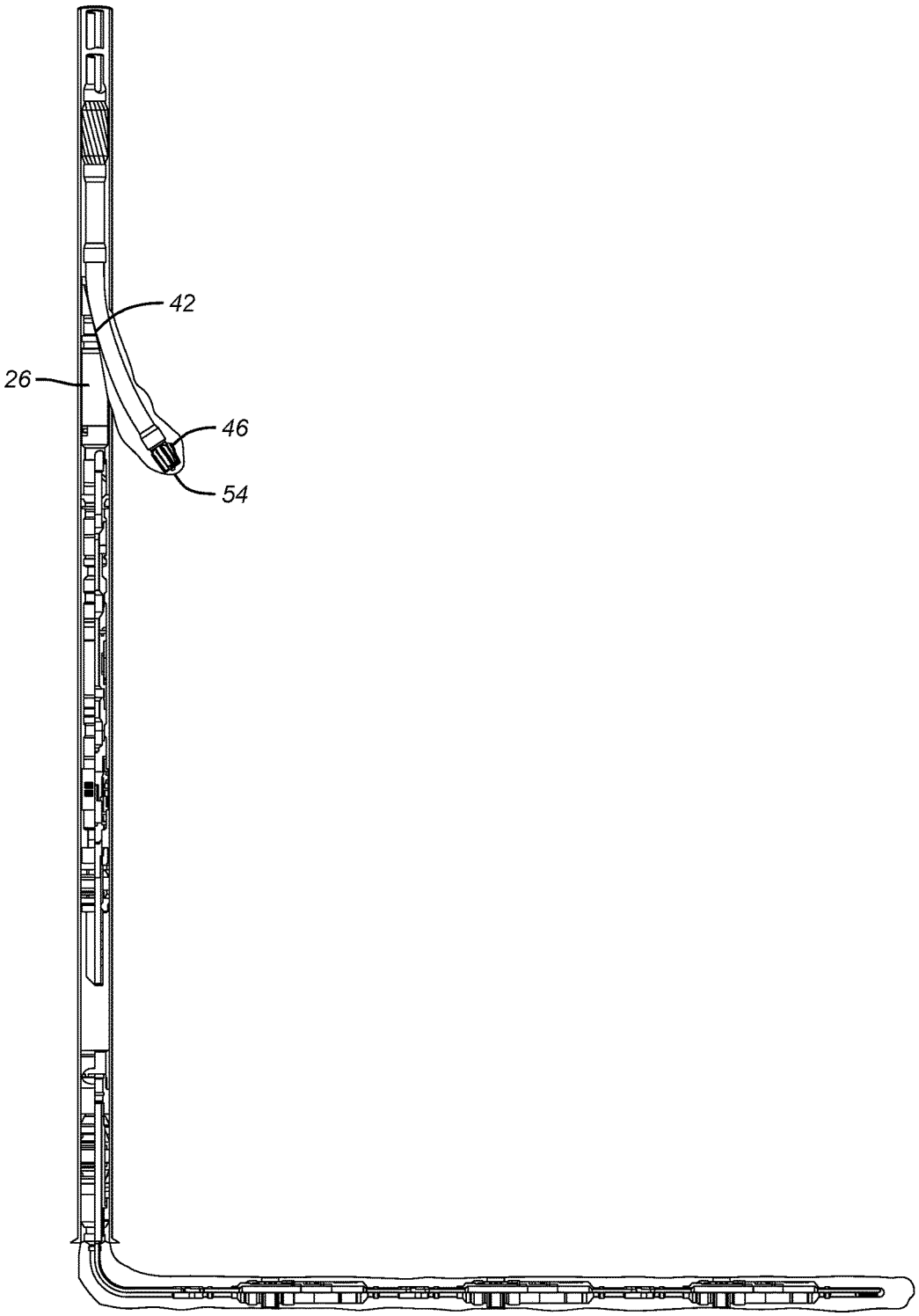
FIG. 5 shows the milling assembly starting the lateral.
Figure 6:
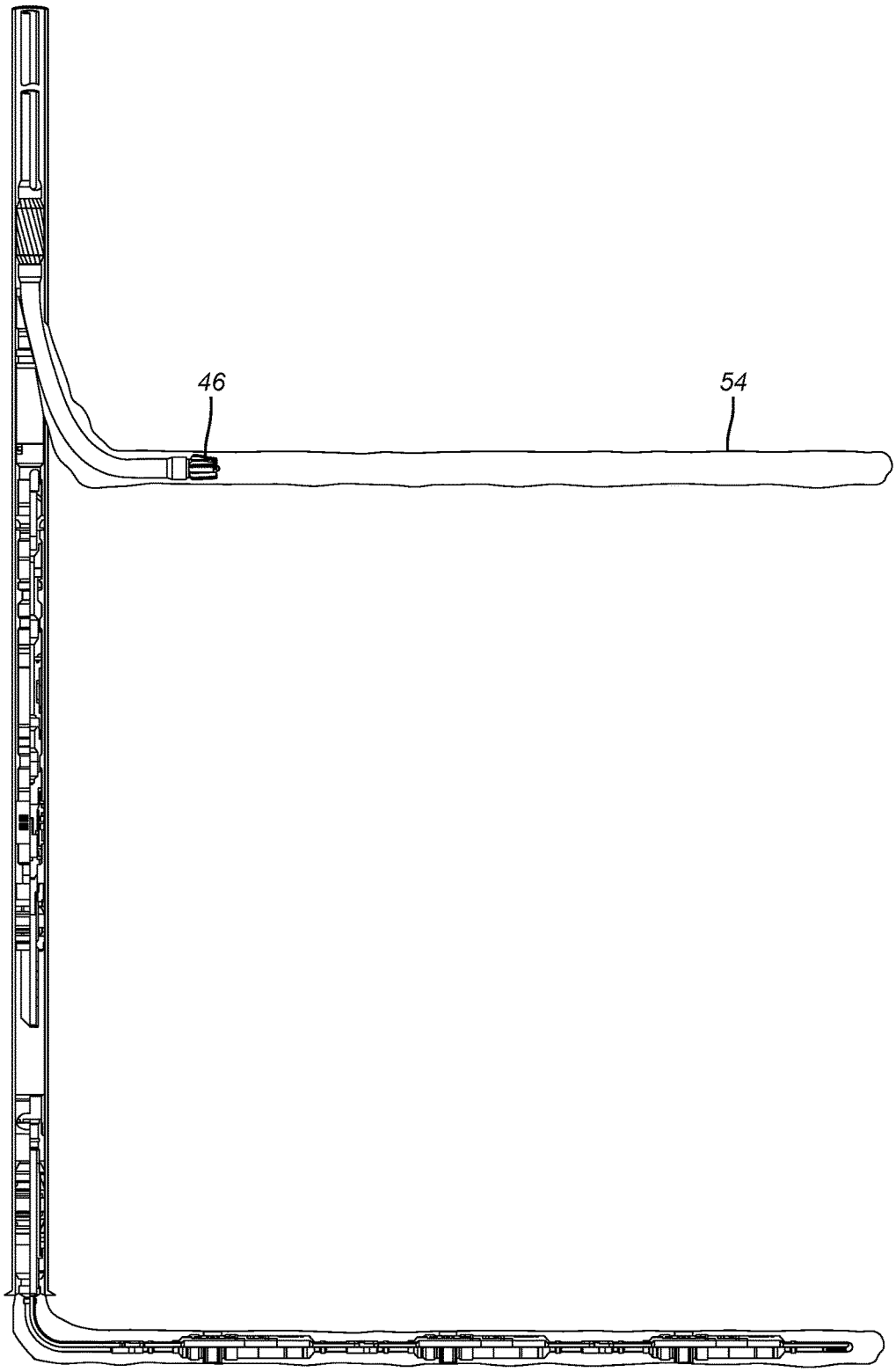
FIG. 6 shows the lateral drilled and the mills being retracted.
Figure 7:
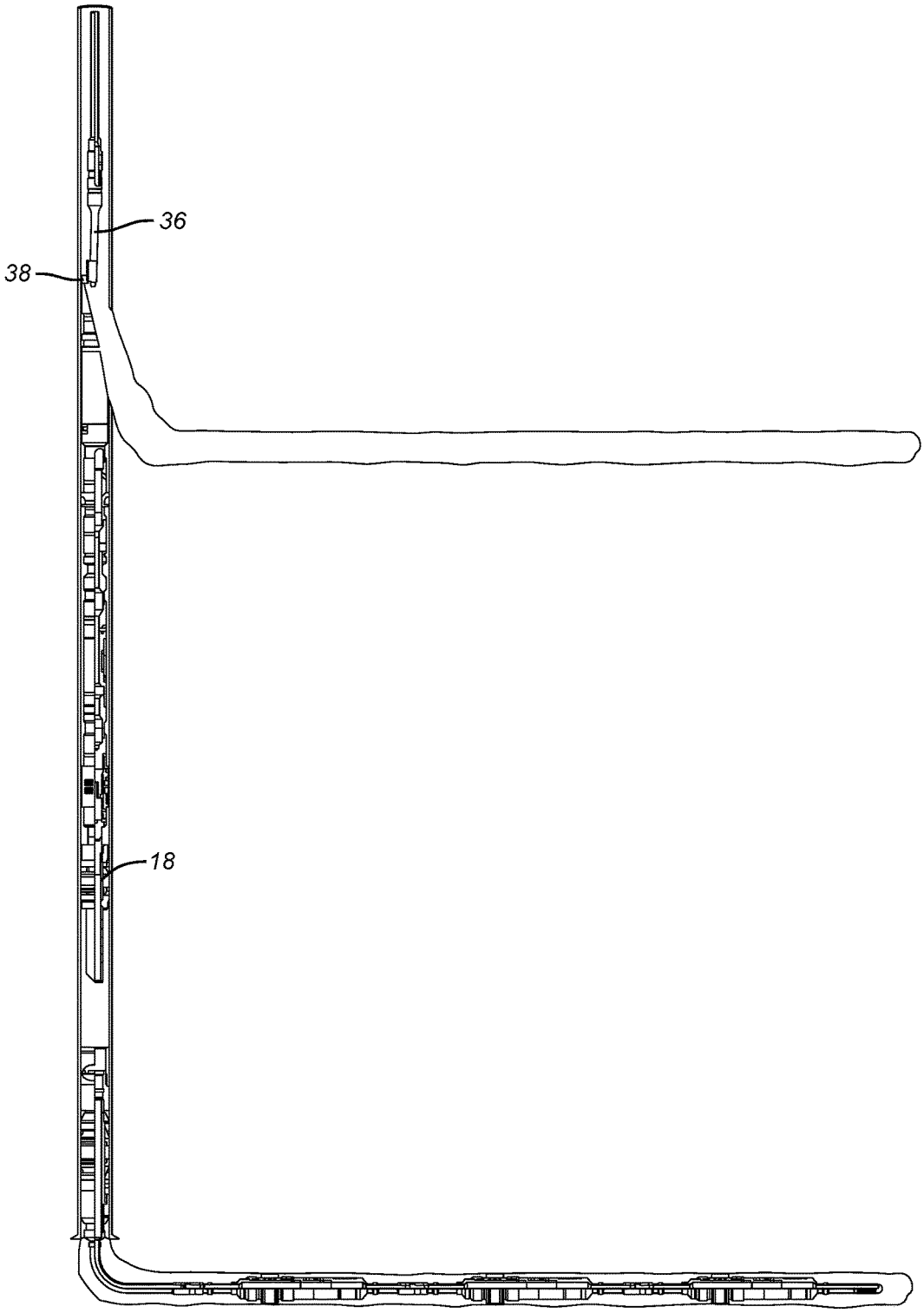
FIG. 7 shows the whipstock being removed from the seal bore packer in the main bore.

FIG. 5 shows mill 46 beginning lateral 54 due to deflection of mill 46 by ramp 42 in a known manner. In FIG. 6 the lateral 54 is drilled and the mill 46 is pulling out of lateral 54. In FIG. 7 the assembly 22 is removed with tool 36 having lug 38 in recess or opening 40 in ramp 42.

Figure 8:
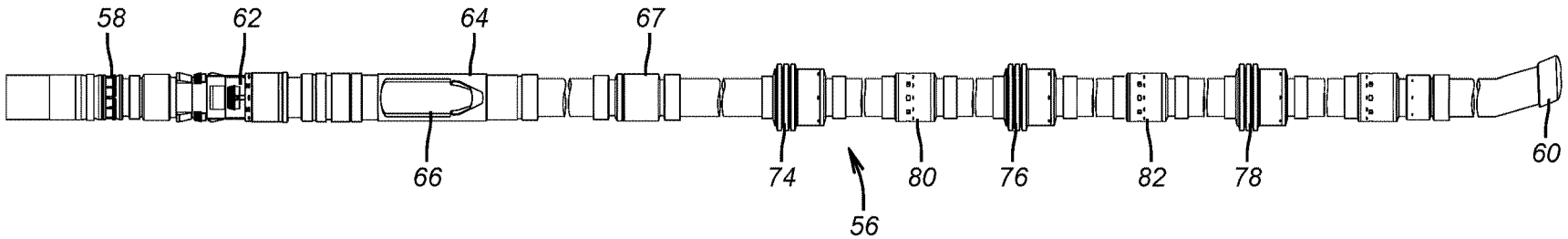
FIG. 8 is a detailed view of a completion assembly that operates on a single ball size.
Figure 9:
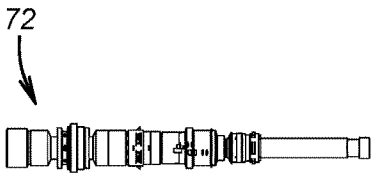
FIG. 9 is the running tool for the assembly of FIG. 8.

FIG. 8 shows a treatment assembly 56 that is run in with a running tool 72 shown in FIG. 9. The assembly has a packer 58 at one end and a float shoe 60 at the opposite end. In between is a liner hanger 62, a diverter housing 64 with an opening 66, a swivel 67 followed by spaced packers 74, 76 and 78. In between the packers are ball activated frack sleeves 80 and 82. The running tool of FIG. 9 delivers the assembly 56 to the lateral 54. The running tool is a type known in the art. The packers 74, 76 and 78 and sleeves 80 and 82 are intended to be a schematic presentation of an arrangement that sequentially operates sleeves with a single ball size. Such systems are known as described above and can use a common ball that sequentially lands on different seats after being pushed through a seat above or can be an arrangement where releasing a ball from one seat reconfigures a seat above to get smaller so that another ball of the same size can be deployed on the seat above. While such systems have been employed before in single bores, their application in a multi-lateral well is new. The purpose of using such a system in a multi-lateral is to maintain the maximum number of frac stages through a diverter that is designed for delivery and removal through a surface string as will be described below.

Figure 10:
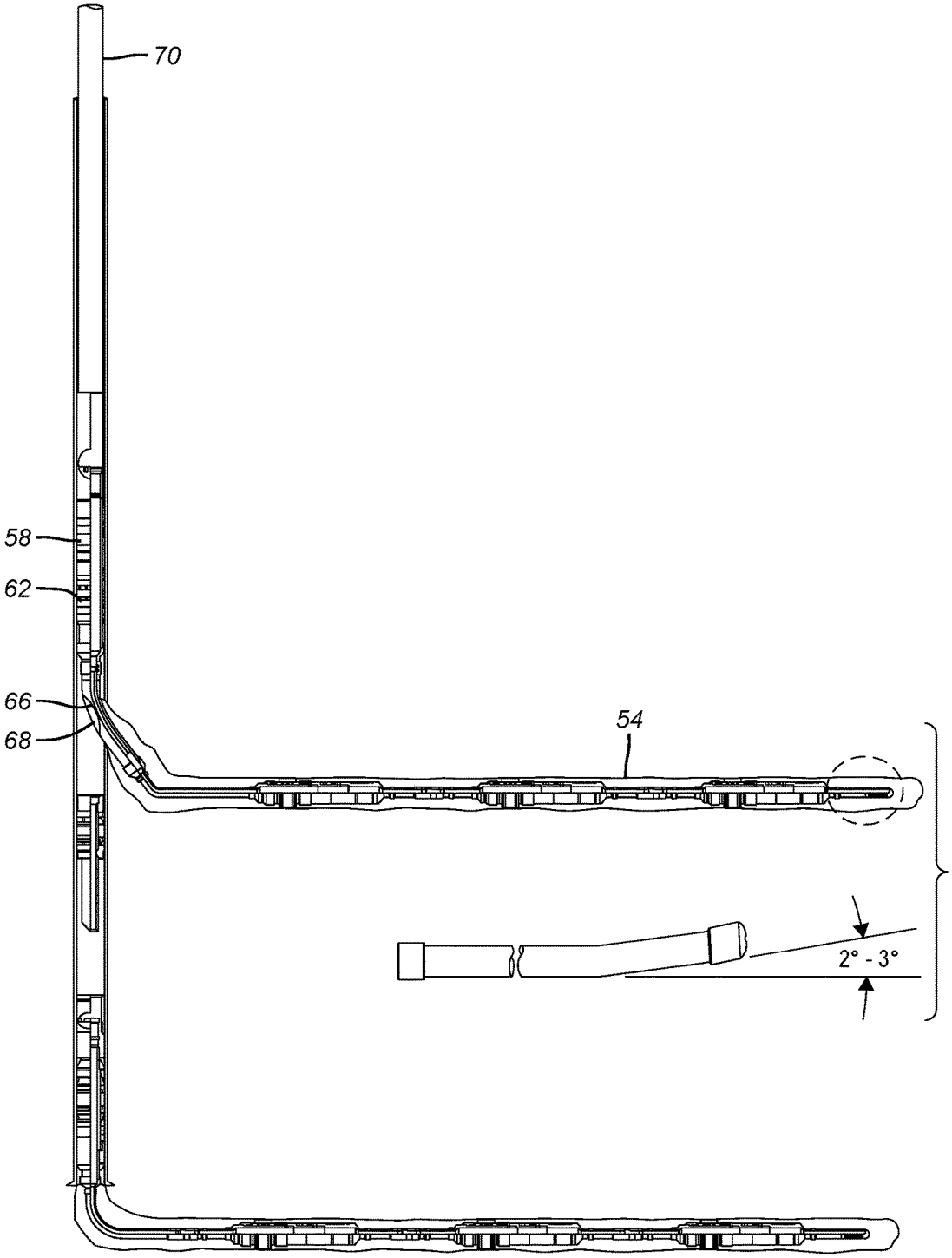
FIG. 10 shows the assembly of FIG. 8 run into the lateral with a through tubing removable diverter.
Figure 11:
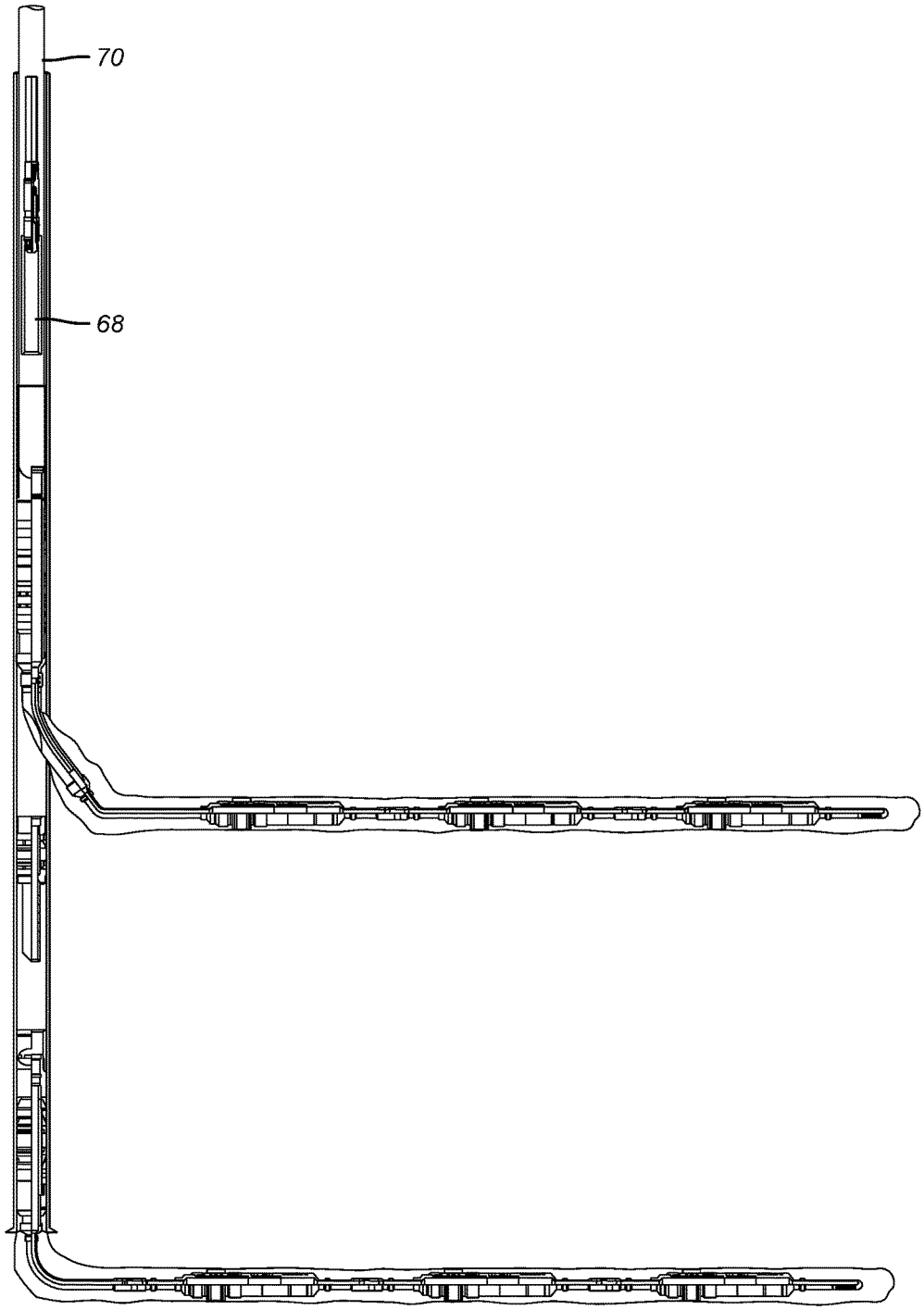
FIG. 11 shows the diverter being removed through the surface string.
Figure 12:
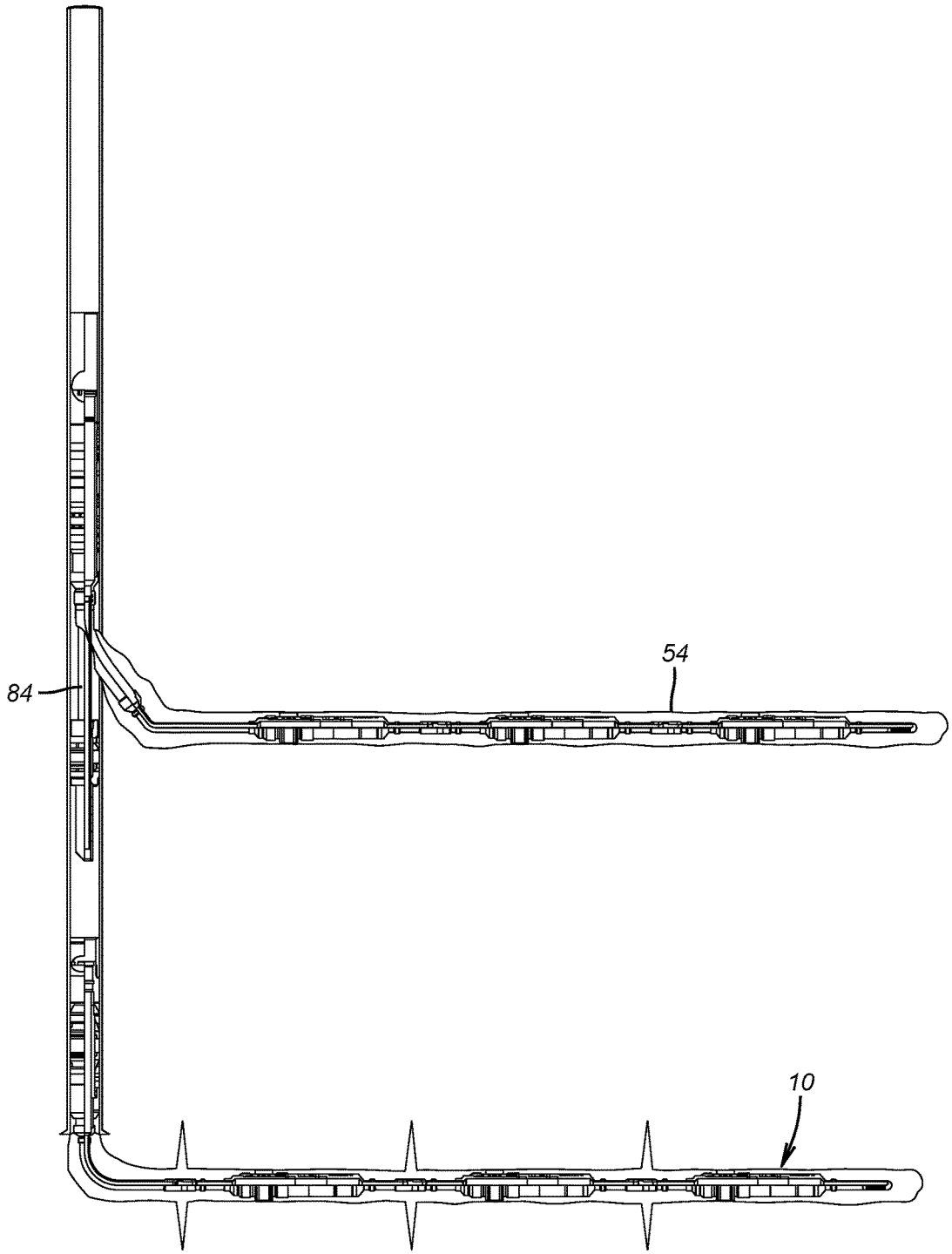
FIG. 12 shows a main bore diverter inserted through the surface string so that the main bore can be treated.
Figure 13:
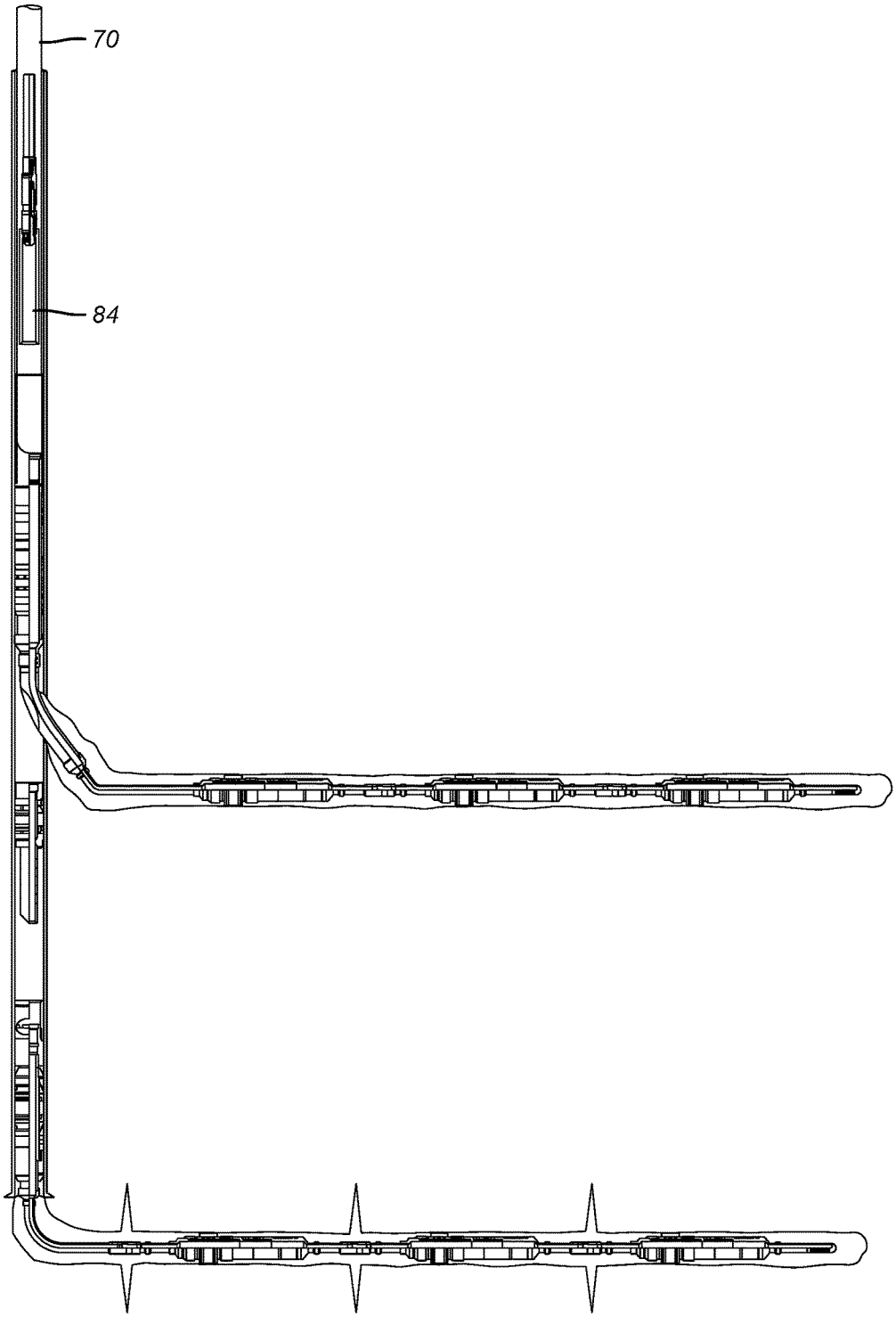
FIG. 13 shows the main bore diverter being removed through the surface string.
Figure 14:
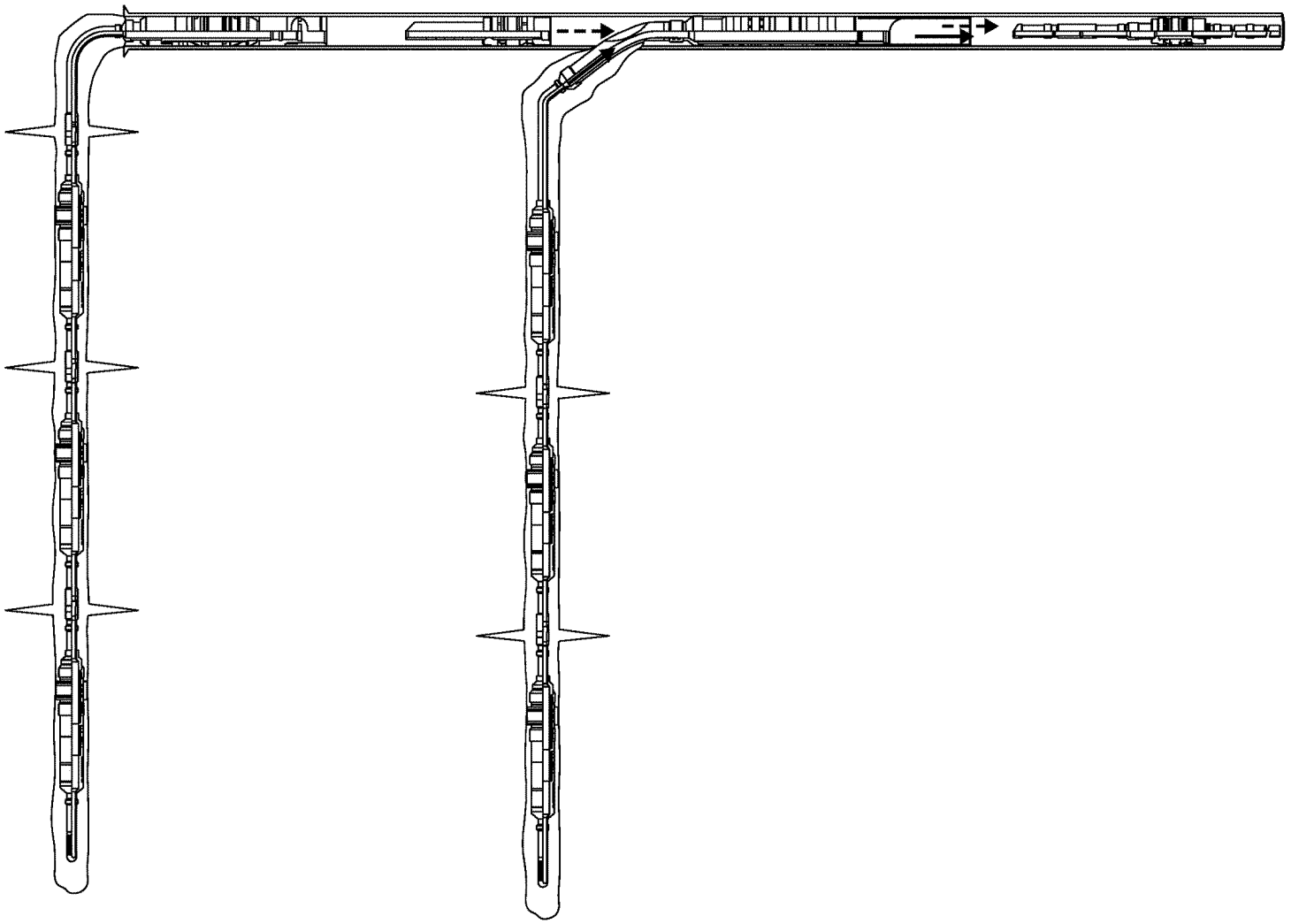
FIG. 14 shows production from the main bore or the lateral.

In FIG. 10 a diverter 68 covers opening 66. Diverter 68 is assembled into assembly 56 and the assembly 56 is steered into the lateral 54 using a bent joint associated with float shoe 60. The packer 58 and hanger 62 are set in casing 12 in the main bore. With the diverter 68 blocking opening 66 the rest of the main bore 14 is isolated from flow. Treating can now take place in lateral 54 after which the diverter 68 comes out through a surface string 70 that was tagged into packer 58 as shown in FIG. 11. FIG. 12 shows another diverter 84 delivered through string 70 so that lateral 54 is isolated and the horizontal bore 10 can be treated. Thereafter the diverter 84 is removed through surface string 70 as shown in FIG. 13 and either or both locations can then be produced as shown in FIG. 14.

The ability to deliver and remove diverters through a surface string saves the time and expense of pulling the surface string to get the diverters out. While only a single lateral is shown to illustrate the concept, the technique is applicable to one or more laterals in a main bore and the time and cost savings increase as more trips out of the hole with the surface string are avoided each time a diverter change is required. Making the diverter small enough to go through the surface string necessarily decreases the drift dimension through it. While single ball size treatment systems have been used in single bore applications, their use in a multi-lateral borehole is new and facilitates compensation for diverters that can be made small enough to be delivered and retrieved through the surface string while maximizing the number of fracturing stages. The main bore or any or all laterals can have the treatment assembly that uses the single size ball technique.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A multi-lateral treatment assembly, comprising:

a main bore having a treatment bottom hole assembly therein;

at least one lateral bore having a treatment bottom hole assembly therein;

at least one diverter associated with one of said treatment bottom hole assemblies for selectively directing flow into one of said treatment bottom hole assemblies;

a surface string connected to said treatment bottom hole assembly where said diverter is mounted;

said diverter removable or insertable through said surface string into at least one of said treatment bottom hole assemblies.

2. The assembly of claim 1, wherein:

said diverter is removable or insertable without removal or re-insertion of said surface string.

3. The assembly of claim 1, wherein:

at least one of said treatment bottom hole assemblies comprises sleeves between external packers that are operated with an object having one size.

4. The assembly of claim 3, wherein:

all of said treatment bottom hole assemblies comprise sleeves between spaced external packers that are operated with an object having one size.

5. The assembly of claim 4, wherein:

said sleeves are operated with a single object.

6. The assembly of claim 4, wherein:

said sleeves are operated with multiple objects having the same size.

7. A multi-lateral treatment method, comprising:

positioning treatment assemblies in a main bore and at least one lateral bore;

locating a first diverter in one of said treatment assemblies to direct flow to one said bore through said diverter by way of a surface string in fluid communication with said diverter for treatment therethrough;

removing said diverter through said surface string.

8. The method of claim 7, comprising;

inserting a second diverter through said surface string after removal of said first diverter to direct flow to another of said bores.

9. The method of claim 7, comprising;

leaving said surface string in place when removing said first diverter.

10. The method of claim 7, comprising;

delivering said first diverter with one of said treatment assemblies.

11. The method of claim 8, comprising;

leaving said surface string in place when removing said second diverter.

12. The method of claim 7, comprising;

providing spaced packers with valve members in between where said valve members have a single bore.

* * * * *